US008157306B1

(12) United States Patent
Guerin

(10) Patent No.: US 8,157,306 B1
(45) Date of Patent: Apr. 17, 2012

(54) DEVICE FOR INSTALLING AND REMOVING CEILING PANELS

(75) Inventor: Philip Guerin, Lawrence, MA (US)

(73) Assignee: Professional Engineering Co., Inc., Lawrence, MA (US)

( * ) Notice: Subject to any disclaimer, the term of this patent is extended or adjusted under 35 U.S.C. 154(b) by 325 days.

(21) Appl. No.: 12/381,410

(22) Filed: Mar. 12, 2009

(51) Int. Cl.
*B66F 19/00* (2006.01)

(52) U.S. Cl. ..... 294/209

(58) Field of Classification Search ..... 294/19.1, 294/24, 85; 52/749.1, 749.11, 747.1, 747.11, 52/127.1, 172.2, 172.5; 248/544
See application file for complete search history.

(56) References Cited

U.S. PATENT DOCUMENTS 4,019,769 A * 4/1977 Filion ..... 294/19.1
4,261,607 A 4/1981 Pilcher
4,335,913 A 6/1982 Lick
4,560,031 A * 12/1985 Dixon et al. ..... 182/129
4,600,348 A * 7/1986 Pettit ..... 414/11
4,928,341 A * 5/1990 Pacione ..... 15/105
6,047,520 A * 4/2000 Caraballo ..... 52/749.11
6,176,063 B1 * 1/2001 Warin ..... 52/749.1
6,471,270 B1 10/2002 Mituniewicz

* cited by examiner

*Primary Examiner* — Saul Rodriguez
*Assistant Examiner* — Stephen Vu
(74) *Attorney, Agent, or Firm* — David M. Driscoll, Esq.

(57) ABSTRACT

A device for removing and installing ceiling panels and that includes a base member having opposed ends and a support piece on the base member for supporting the base member in an overhead position. A pair of elongated support arms are mounted at a location intermediate the opposed ends of each elongated support arm to respective opposed ends of the base member. A pair of fasteners, one for each elongated support arm, secures the lower side of each elongated support arm to the upper side of the base member at the respective opposed ends of the base member. Nails or the like are mounted to the respective pair of elongated support arms engageable with a ceiling panel to assist in the removal thereof. A pair of retention hooks is mounted from one of the base member at opposed ends thereof and respective elongated support arms and engageable with a ceiling panel to assist in the installation thereof.

14 Claims, 17 Drawing Sheets

DEVICE FOR INSTALLING AND REMOVING CEILING PANELS

FIELD OF THE INVENTION

The present invention relates in general to a device or tool for installing or removing ceiling panels from a support grid used in a typical suspended ceiling arrangement. More particularly, the present invention relates to a single device that can be readily modified for use either as a tool for removing ceiling panels or for installing ceiling panels.

BACKGROUND OF THE INVENTION

A suspended ceiling is usually formed by a support grid which is constructed of T-shaped support members arranged in a grid pattern. The support members are typically arranged in a generally rectangular grid pattern. Rectangular ceiling panels are then mounted into place within the rectangular areas formed by the support members. These ceiling panels, which are usually acoustic panels may be constructed of many different types of materials including a fibrous material such as mineral fiber or fibrous glass.

At the present time one way to install these panels is by hand. However, this installation or removal procedure is time consuming and usually requires a ladder or scaffolding to install these ceiling panels, as the panels are not usually reachable directly from the floor.

If a workman is using a ladder then the ladder has to be continually moved to the next area in which a panel is to be mounted. In addition, a ladder does not provide sufficient space for storing panels within the reach of the workman when he is in position on the ladder. As a result, the workman must either carry a panel with him as he climbs up the ladder or have another workman hand him a panel once he is positioned on the ladder. Both of these procedures are highly undesirable because they increase the risk of accident. In addition, the aid of a second workman increases installation costs.

The use of a scaffolding is similarly undesirable because setting up a scaffolding is time consuming. In addition, the scaffolding must be moved each time a panel or section of panels are installed. Relocation of the scaffolding requires the workman installing the panels to climb down from the scaffolding to move it to the new position and to then return to the platform for installation of the next series of panels. This course of conduct is undesirable because it is inconvenient and time consuming. Another method for moving the scaffolding consists of having additional workmen on the ground move the scaffolding to a new position once a panel or section of panels have been installed. This technique, however, is also undesirable because the additional workmen needed to move the scaffolding increase the cost of installing the ceiling panels.

U.S. Pat. No. 4,261,607 to Pilcher and U.S. Pat. No. 4,335,913 also show apparatus for installing ceiling panels. However, these devices, particularly for installation purposes, can deform or damage the ceiling panel during the installation phase. These devices are also rather cumbersome in use and are not able to be made in a compact structure.

Accordingly, it is an object of the present invention to provide an improved device that can be used for both installing and removing ceiling panels from the support grid of a suspended ceiling whereby a workman using the tool can install or remove panels from a high ceiling without the use of a ladder or scaffolding.

Another object of the present invention is to provide a device for installing or removing ceiling panels from the support grid of a suspended ceiling whereby a workman can use the tool from the floor to thereby make the installation process more efficient and less time consuming.

A further object of the present invention is to provide a device which facilitates the installation or removal of ceiling panels whereby the device is readily convertible for the alternate use of either installation or removal.

It is a further object of the present invention to provide an improved device for ceiling panel installation or removal and which is simple and economical to construct, which may be quickly and easily used, which is adapted for use with ceilings located at various heights, and which can be readily nestable for transport.

SUMMARY OF THE INVENTION

To accomplish the foregoing and other objects, features and advantages of the present invention there is provided a device for removing and installing ceiling panels, comprising: a base member having upper and lower sides and opposed ends and a support piece on the base member on the upper side thereof and disposed intermediate the opposed ends of the base member. The support piece is for supporting the base member in an overhead position for the purpose of either removing or installing ceiling panels therewith. The device further includes a pair of elongated support arms each also having upper and lower sides and opposed ends. Each elongated support arm is mounted at a location intermediate the opposed ends of each elongated support arm to respective opposed ends of the base member. The elongated support arms are disposed in parallel to each other and substantially transverse to the base member. A pair of fasteners, one for each elongated support arm, secure the lower side of each elongated support arm to the upper side of the base member at the respective opposed ends of the base member. At least two piercing pieces are mounted to the respective pair of elongated support arms engageable with a ceiling panel to assist in the removal thereof. Also, a pair of retention hooks are mounted from one of the base member at opposed ends thereof and respective elongated support arms and engageable with a ceiling panel to assist in the installation thereof. The retention hooks are pivotal between a use position wherein respective ones thereof are engageable with sides of the ceiling panel, and a released position wherein the retention hooks are disengaged from the ceiling panel.

Further aspects of the present invention include the elongated support arms are removably mounted with the base member by means of the respective fasteners; the pair of elongated support arms has a use position wherein the elongated support arms are disposed in parallel to each other and substantially transverse to the base member, and a nested position wherein the elongated support arms are disposed in parallel with the base member, and further including an elastic strap that surrounds the elongated support arms and base member to hold the elongated support arms and base member together; including two sets of piercing pieces, one set associated with each elongated support arm and disposed at opposed ends thereof; the base member has opposed end holes for accommodating piercing pieces of the elongated support arms in the nested position of the elongated support arms; including at least one spacer on the base member for spacedly positioning the elongated support arms in the nested position; the fastener is a threaded bolt and the base has a threaded through hole so that either side of the elongated support arm can engage the base member; and including a pole attached to the support piece.

In accordance with the present invention there is also provided a device for removing ceiling panels, comprising: an elongated base member having opposed sides and opposed ends and a support piece on the base member on one of the opposed sides thereof and disposed intermediate the opposed ends of the base member. The support piece is for supporting the base member in an overhead position for the purpose of removing ceiling panels therewith. The device also includes a pair of elongated support arms each also having opposed sides and opposed ends with each elongated support arm mounted at a location intermediate the opposed ends of each elongated support arm to respective opposed ends of the base member. The elongated support arms are disposed substantially in parallel to each other and substantially transverse to the base member. A pair of fasteners, one for each elongated support arm, secure the one side of the opposed sides of each elongated support arm to another side of the opposed sides of the opposed sides of the base member at the respective opposed ends of the base member. At least two piercing pieces are mounted to the respective pair of elongated support arms engageable with a ceiling panel to assist in the removal thereof; wherein the pair of elongated support arms has a use position wherein the elongated support arms are disposed in parallel to each other and substantially transverse to the base member, and a nested position wherein the elongated support arms are disposed in parallel with the base member.

Still further aspects of the present invention include the elongated support arms are removably mounted with the base member by means of the respective fasteners; including an elastic strap that surrounds the elongated support arms and base member to hold the elongated support arms and base member together; including two sets of piercing pieces, one set associated with each elongated support arm and disposed at opposed ends thereof; the base member has opposed end holes for accommodating piercing pieces of the elongated support arms in the nested position of the elongated support arms; including at least one spacer on the base member for spacedly positioning the elongated support arms in the nested position; and including a pole attached to the support piece.

In accordance with the present invention there is also provided a device for installing ceiling panels, comprising: an elongated base member having opposed sides and opposed ends and a support piece on the base member one of the opposed sides thereof and disposed intermediate the opposed ends of the base member. The support piece is for supporting the base member in an overhead position for the purpose of installing ceiling panels therewith. The device also includes a pair of elongated support arms each also have opposed sides and opposed ends with each elongated support arm mounted at a location intermediate the opposed ends of each elongated support arm to respective opposed ends of the base member. The are elongated support arms disposed in parallel to each other and substantially transverse to the base member. A pair of fasteners, one for each elongated support arm, secure the one side of the opposed sides of each elongated support arm to another side of the opposed sides of the base member at the respective opposed ends of the base member. A pair of retention hooks are mounted from one of the base member at opposed ends thereof and respective elongated support arms and engageable with a ceiling panel to assist in the installation thereof. The retention hooks are pivotal between a use position wherein respective ones thereof are engageable with sides of the ceiling panel, and a released position wherein the retention hooks are disengaged from the ceiling panel.

Other aspects of the present invention include the elongated support arms are removably mounted with the base member by means of the respective fasteners; the pair of elongated support arms has a use position wherein the elongated support arms are disposed in parallel to each other and substantially transverse to the base member, and a nested position wherein the elongated support arms are disposed in parallel with the base member, and further including an elastic strap that surrounds the elongated support arms and base member to hold the elongated support arms and base member together; the retention hooks are pivotally supported from the respective elongated support arms; and the retention hooks are pivotally supported from respective opposed ends of the base member.

DESCRIPTION OF THE DRAWINGS

Numerous other objects, features and advantages are now realized by a consideration of the following detailed description taken in conjunction with accompanying drawing, in which.

DETAILED DESCRIPTION

Figure 17:
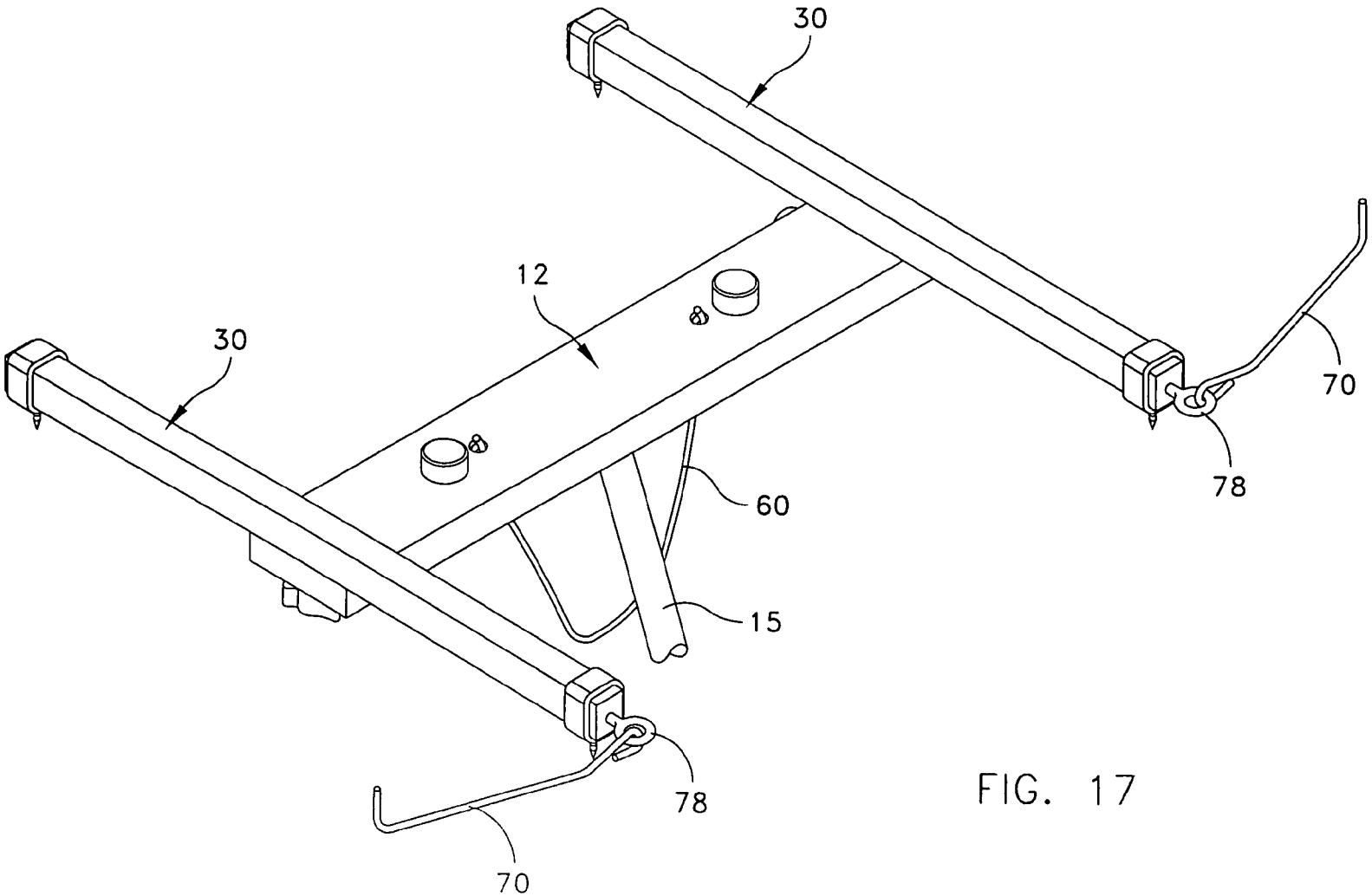
FIG. 17 is a perspective view of a third embodiment of the device of the present invention wherein the retention hooks are supported from the respective arms.
Figure 18:
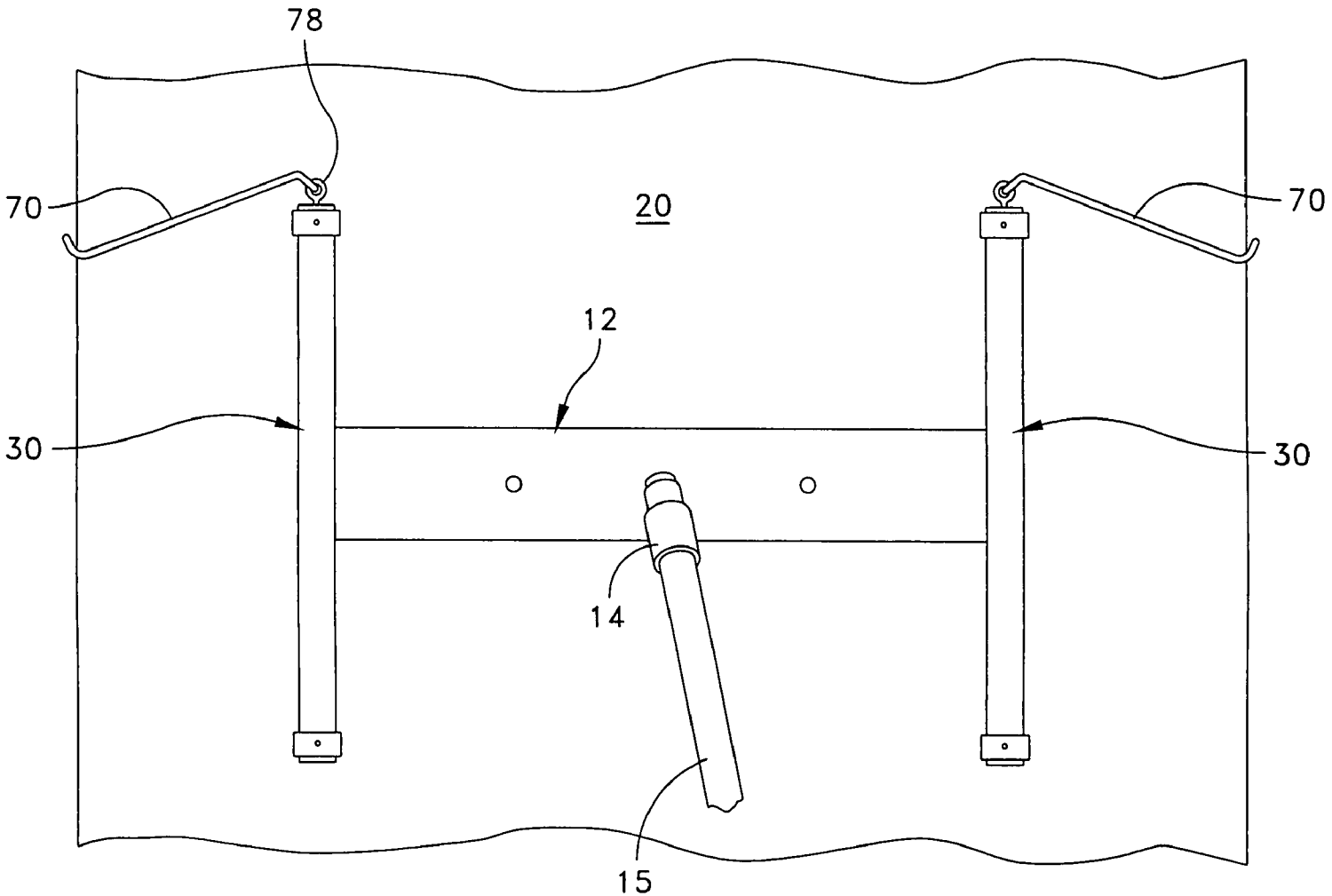
FIG. 18 is a plan view of the device of FIG. 17 with the hooks engaging a ceiling panel.

There are three different embodiments of the present invention that are described herein. A first embodiment is illustrated in FIGS. 1-9 in which the device is used only for ceiling panel removal. FIGS. 10-16 illustrate a preferred second embodiment of the present invention in which the device can be alternately used for either panel removal or installation. An alternate to the second embodiment is illustrated in FIGS. 17 and 18. In addition to the aspect of the present invention of combining the installation and removal features, the device can also be constructed in separate devices with only means for either installation or removal of ceiling panels. The device that includes only means for panel removal is illustrated in FIGS. 1-9. A device, in accordance with the present invention, can also be devised which includes only the retention hooks primarily for panel installation. In that case, in the second embodiment shown herein, the piercing nails could be eliminated.

Figure 1:
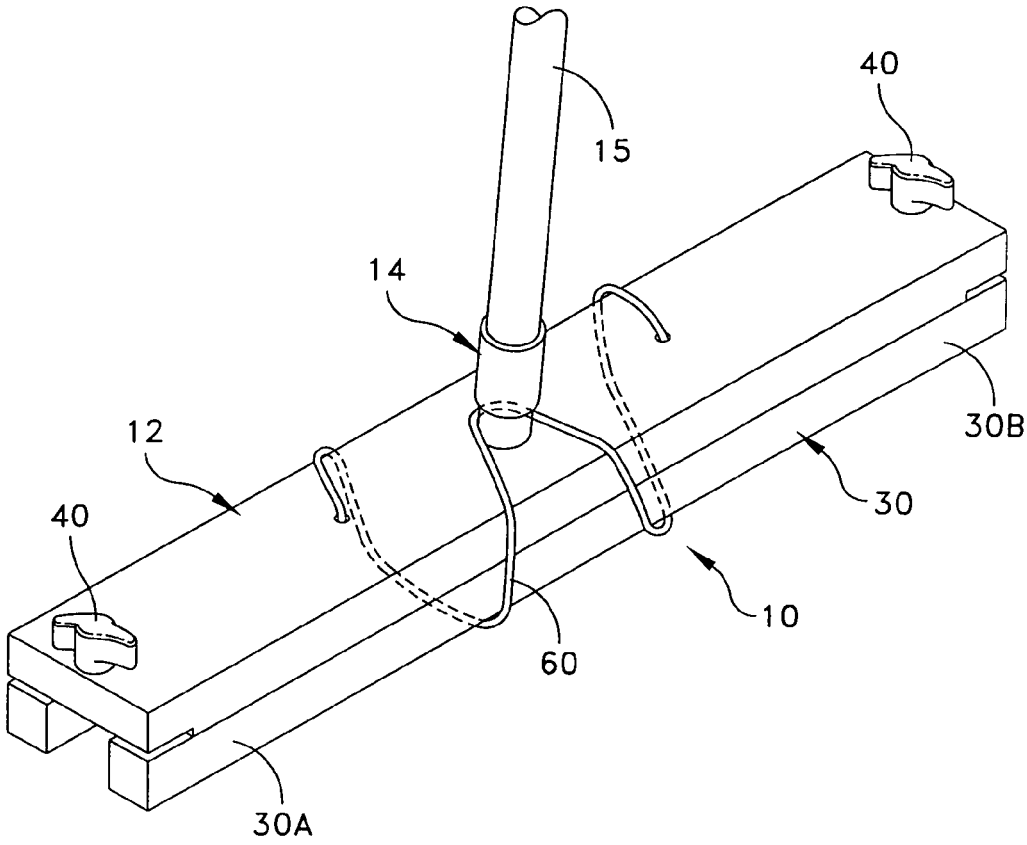
FIG. 1 is a perspective view of a first embodiment of the device present invention in a nested position and for use in removing ceiling panels or tiles.
Figure 2:
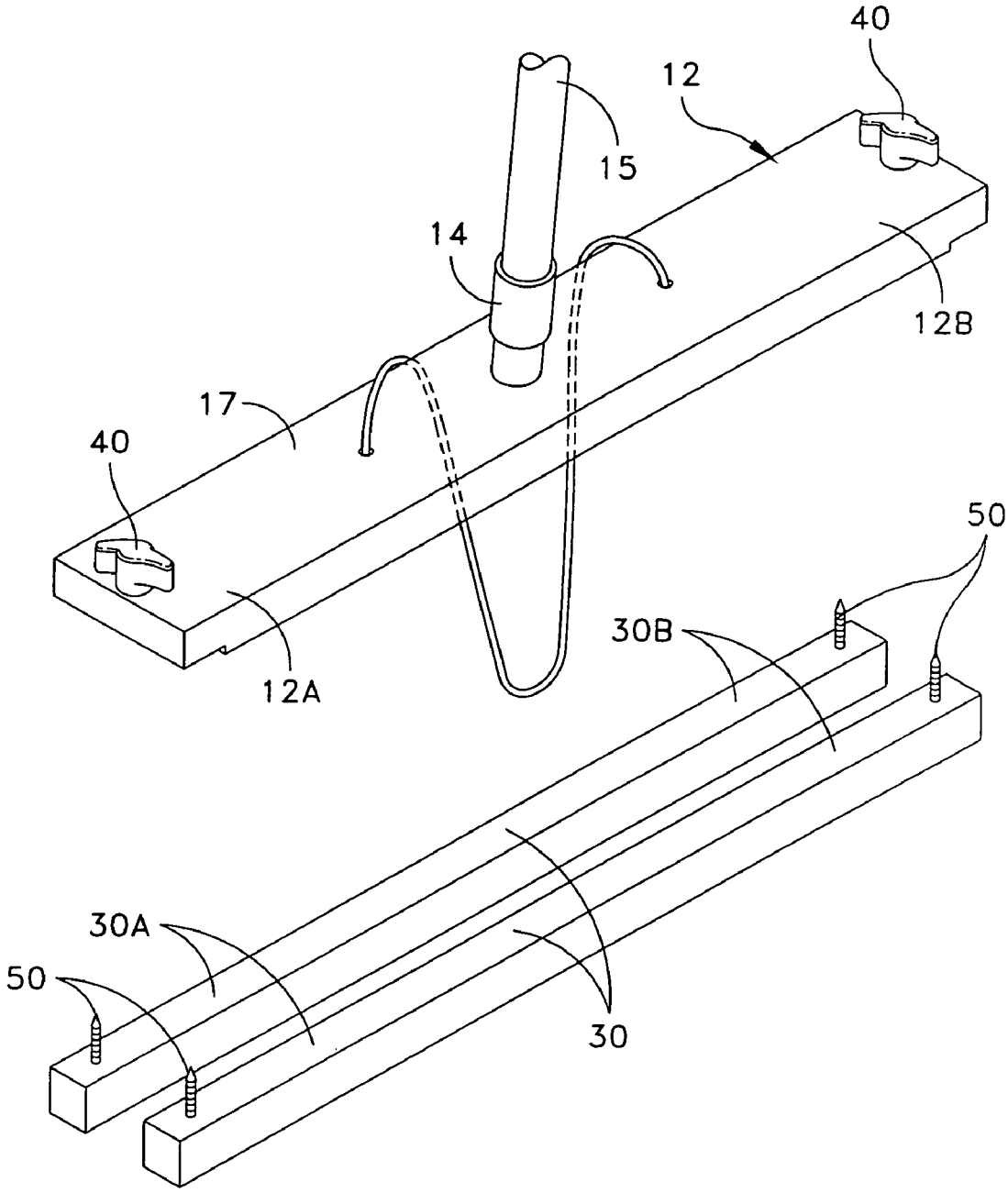
FIG. 2 is an exploded perspective view of the device of FIG. 1.
Figure 3:
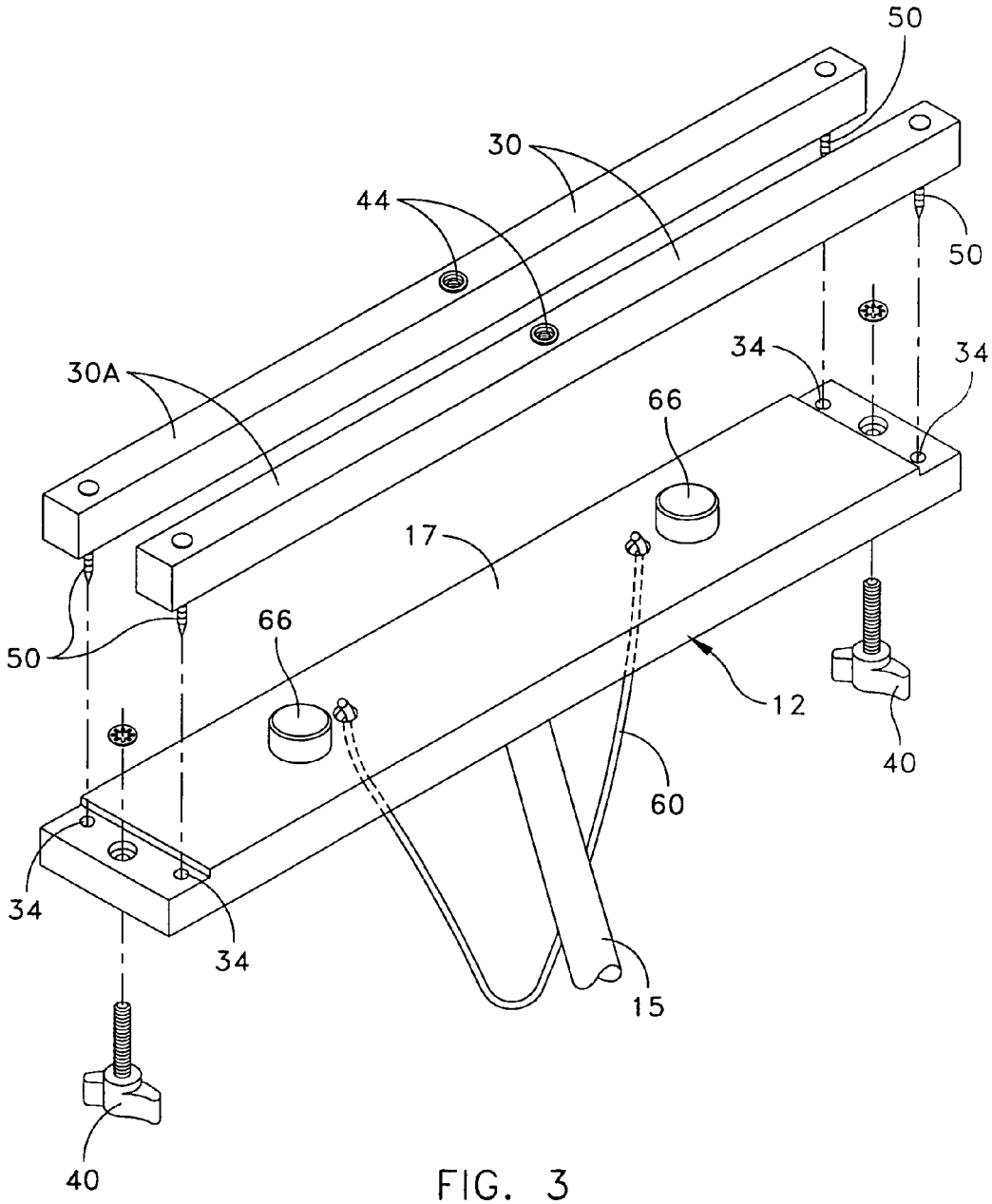
FIG. 3 is an exploded perspective view like that shown in FIG. 2 but from the opposite side.
Figure 4:
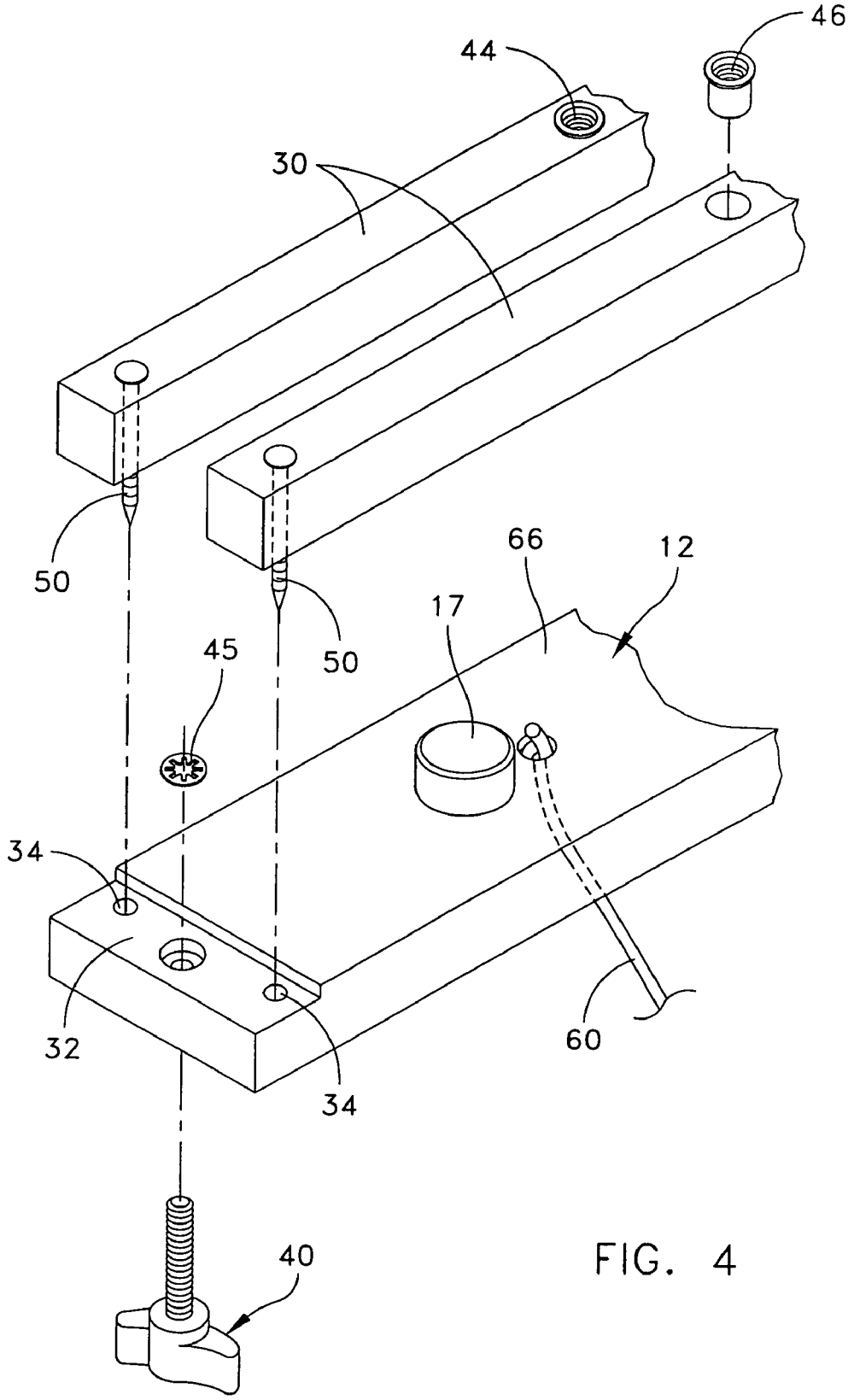
FIG. 4 is a fragmentary perspective view from FIG. 3.
Figure 5:
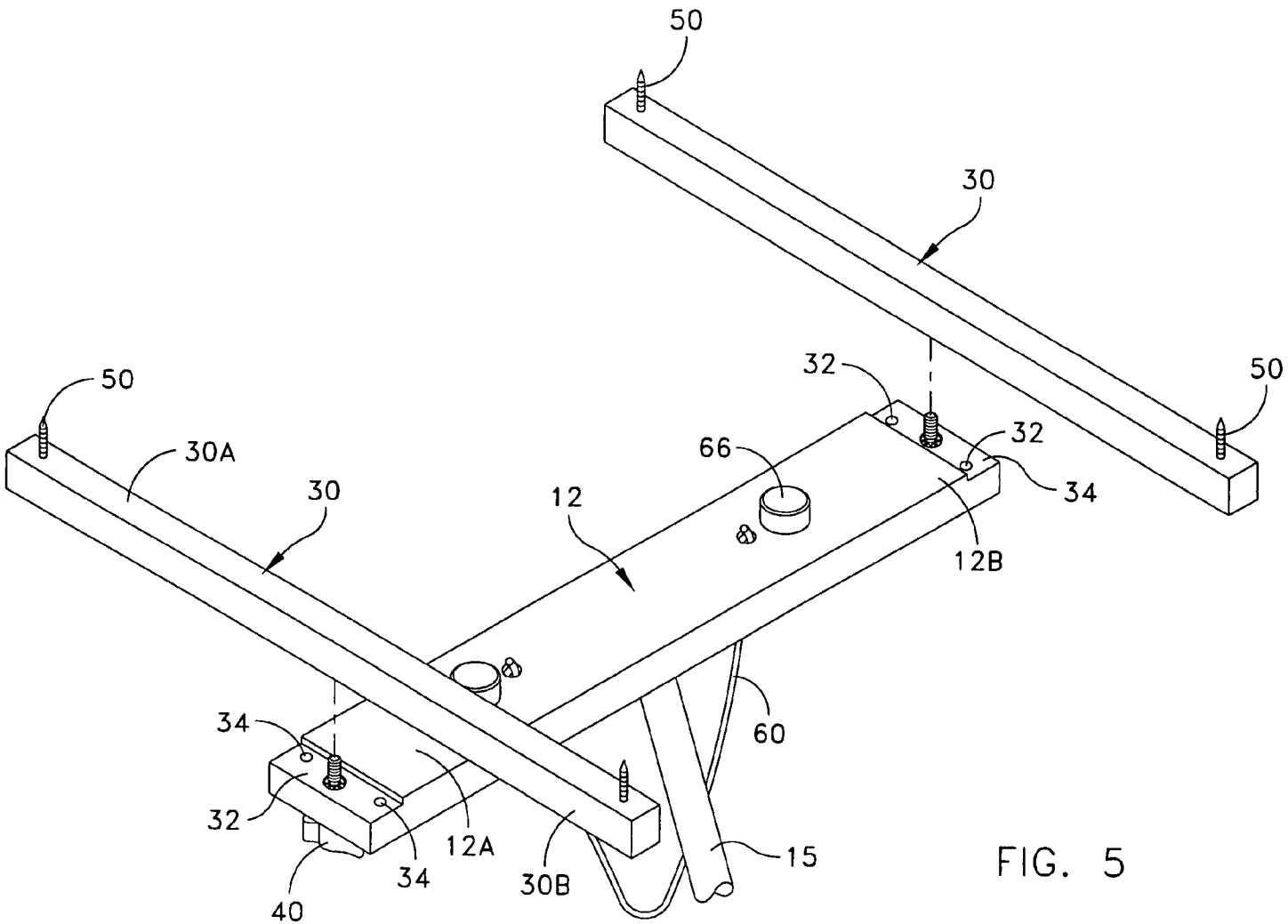
FIG. 5 is an exploded perspective view with the device being set up in the use position.
Figure 6:
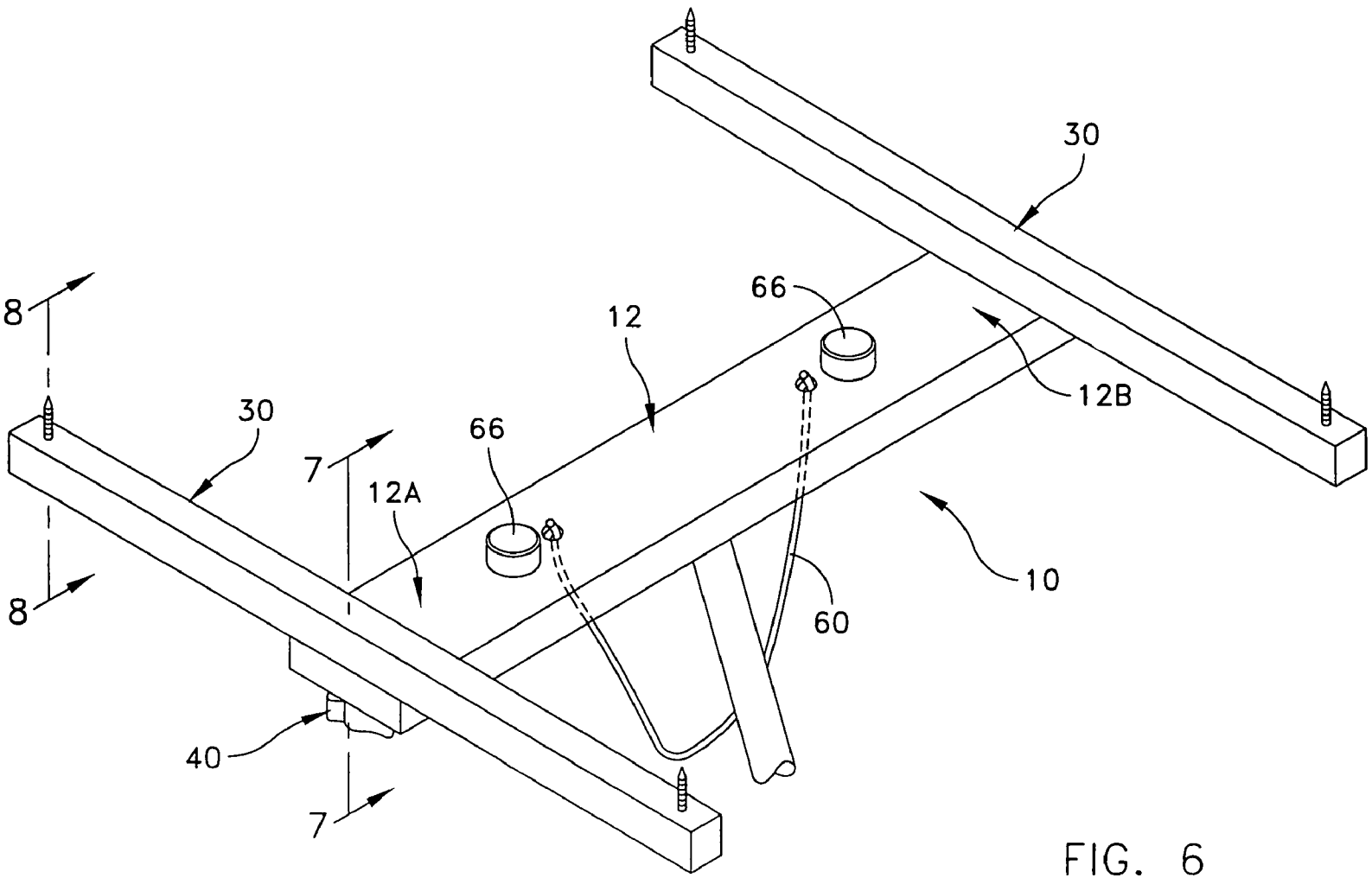
FIG. 6 is a perspective view with the device being set up in the use position.
Figure 7:
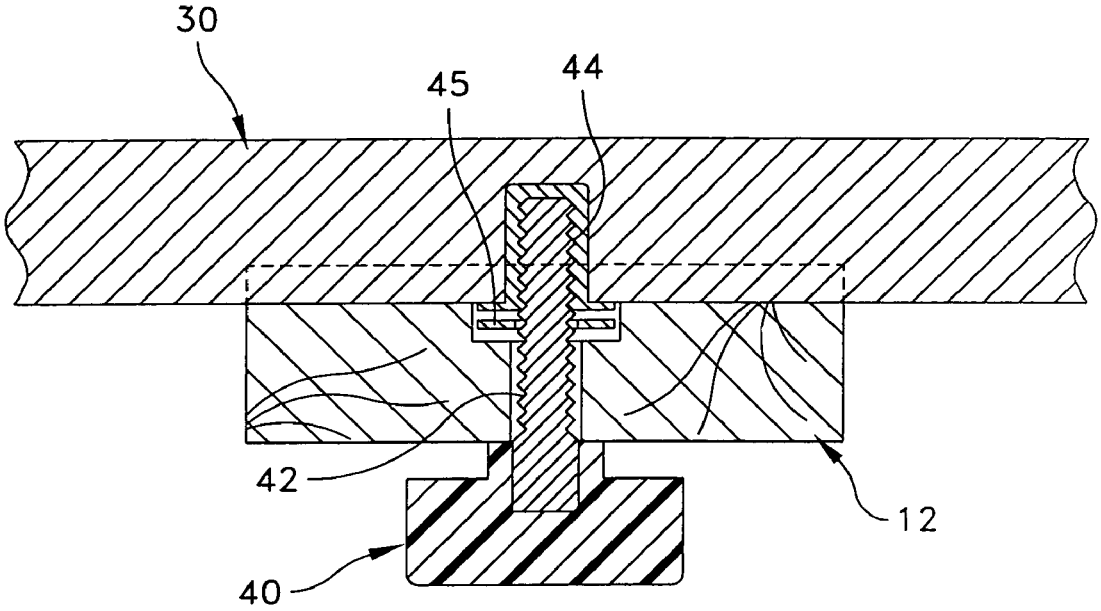
FIG. 7 is a cross-sectional view taken along line 7-7 of FIG. 6.
Figure 8:
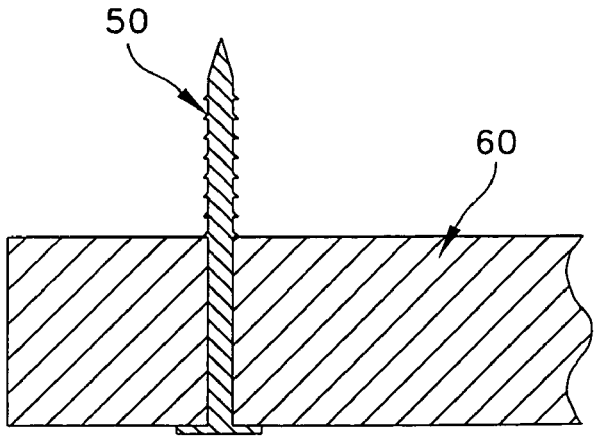
FIG. 8 is a cross-sectional view taken along line 8-8 of FIG. 6.
Figure 9:
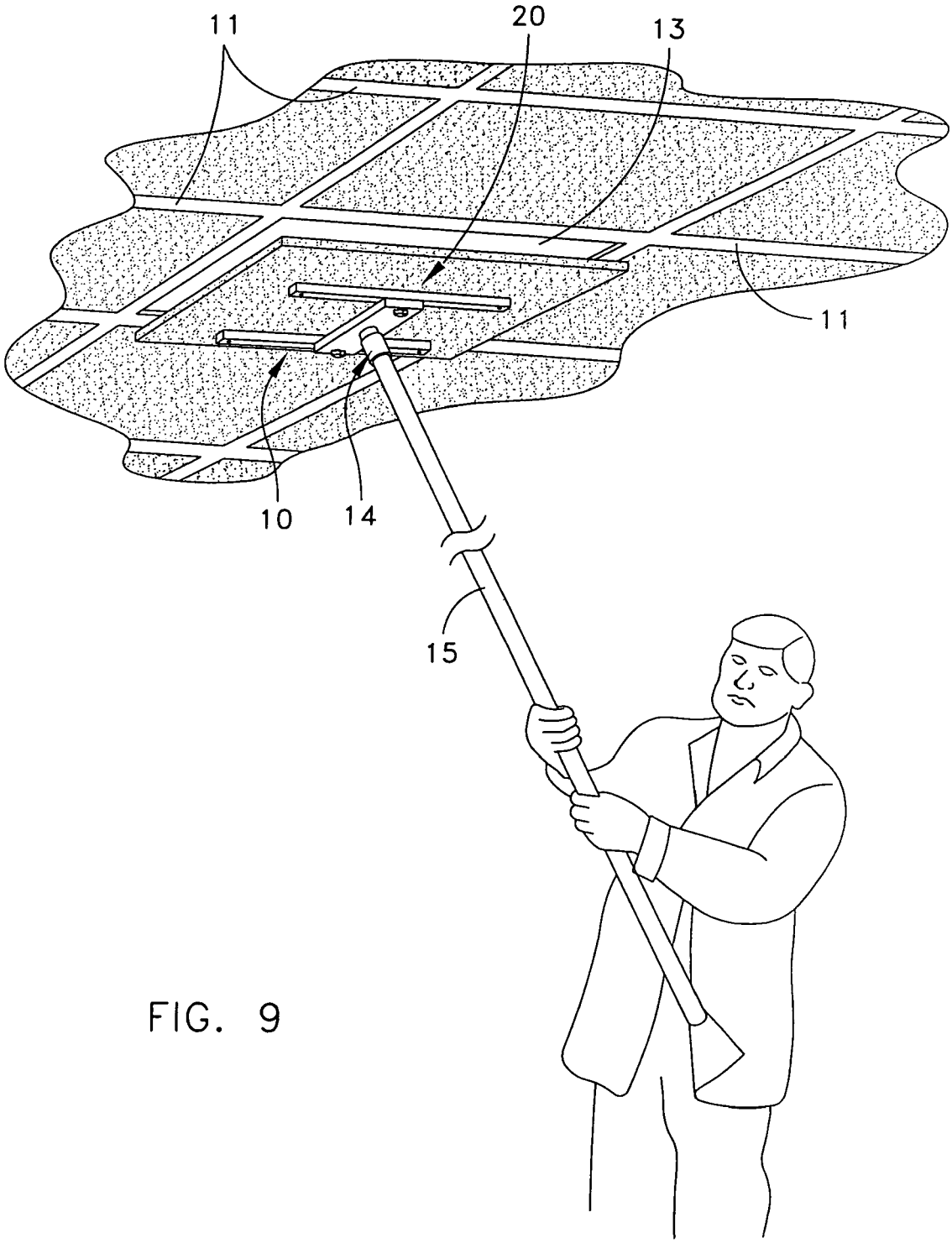
FIG. 9 is a perspective view illustrating a workman using the device to remove a ceiling panel.

Reference is now made to the first embodiment illustrated herein in FIGS. 1-9. FIG. 1 is a perspective view of a first embodiment of the device of the present invention in a nested position and for use in removing ceiling panels or tiles. FIG. 2 is an exploded perspective view of the device of FIG. 1. FIG. 3 is an exploded perspective view like that shown in FIG. 2 but from the opposite side. FIG. 4 is a fragmentary perspective view from FIG. 3. FIG. 5 is an exploded perspective view with the device being set up in the use position. FIG. 6 is a perspective view with the device being set up in the use position. FIG. 7 is a cross-sectional view taken along line 7-7 of FIG. 6. FIG. 8 is a cross-sectional view taken along line 8-8 of FIG. 6. FIG. 9 is a perspective view illustrating a workman using the device to remove a ceiling panel.

In this first embodiment there is illustrated a device 10 that includes a base member 12 having upper and lower substantially flat sides and opposed ends 12A and 12B. A support piece 14 is provided on the base member 12 on the upper side thereof, such as is illustrated in FIGS. 1 and 2, at 17. This support piece 14 is preferably disposed intermediate the opposed ends 12A and 12B of the base member 12. The support piece 14 is for supporting the base member 12 in an overhead position, such as illustrated in FIG. 9 by means of the pole 15. The pole 15 is preferably screwed into the support piece 14. FIG. 9 illustrates the device used for the purpose of removing ceiling panels therewith. In this connection FIG. 9 also shows the typical suspended ceiling system that includes the usual T-shaped cross pieces 11 arranged in a grid pattern. FIG. 9 also shows the ceiling panel 20 being held by the device 10 and in readiness for insertion in the opening 13 defined between these cross pieces 11.

The support piece 14 and pole 15 are preferably fixedly attached to the base member 12 at the following angles. The angle that the base member 12 is in relation to the support piece 14 is provided so that there is a slight tilting of the pole relative to the plane of the base member. The angle in the front to back direction is roughly 7 degrees rotating it backwards. The backwards direction would be toward the user in FIG. 9, with that direction being along the arms 30. In FIG. 9 this angle is somewhat exaggerated.

The angle from side to side is about 8 degrees rotated either left or right, depending on whether the user is right handed or left handed. For a right handed it tilts toward the right and vice versa. The side-to-side direction is along the base member 12. These angles are found to be the best for locating the worker as close to 90 degrees beneath the tile (but to the side of it) so as to see the tile and anything above it as the tile that is being removed is being lifted out of the grid and fed through the opening. The reverse is true for the installation of the tile.

In this first embodiment the device 10 also includes a pair of elongated support arms 30 each also having upper and lower sides and opposed ends 30A and 30B. As shown in the drawings each of the arms 30 has a square or rectangular cross-section. Preferably, at least opposed side surfaces of the elongated support arms are flat so that the arms 30 properly engage with the base member 12, particularly in the use position of the device, such as shown in FIGS. 6 and 9. Each elongated support arm 30 is mounted at a location intermediate the opposed ends 30A, 30B of each elongated support arm 30 and to respective opposed ends 12A, 12B of the base member 12. In the use position of, for example, FIG. 6 elongated support arms 30 are disposed substantially in parallel to each other and substantially transverse to the base member 12.

With further reference to FIGS. 5 and 6, in the use position of the device, the opposed ends 12A, 12B are each preferably provided with a step 32 that assist in the positioning of each arm 30. FIG. 5 is an exploded view showing each of the arms 30 separated from the base member 12, while FIG. 6 shows the assembled position where each of the elongated support arms 30 are engaged with the respective end steps 32 (see also FIG. 4). It is also noted that each of the steps 32 is provided with preferably two spaced apart holes 34. These holes 34 receive the nails of the elongated support arms 30 in the nested position of the device as will be described in further detail hereinafter.

The device further includes a pair of fasteners 40 that is illustrated as threaded bolts having a turn knob end, and one for each elongated support arm 30 to secure the lower side of each elongated support arm 30 to the upper side of the base member 12 at the steps of the respective opposed ends of the base member 12. See FIGS. 6 and 7 for the use position and one of the fasteners 40 that passes through a hole 42 in the base member 12 and into a threaded hole 44 in the elongated support arm 30. This threaded hole 44 is formed by an internally threaded thimble 46 as illustrated in FIG. 4 that fits in the arm hole. The fastener is also preferably held in place with the use of a washer 45 (see FIGS. 4 and 7) that keeps the fastener supported with the base member 12 even when the fastener is not engaged with the elongated support arm 30. When the fasteners are tightened then both of the elongated support members 30 are fixedly attached with the base member 12, in the position shown in FIG. 6.

Each of the elongated support arms 30 is also provided with two piercing pieces 50 that are illustrated as inverted nails. The nails 50 each have pointed ends engageable with a ceiling panel 20 as illustrated in FIG. 9 to assist in the removal thereof. See also FIG. 8 which is a cross-sectional view taken along line 8-8 of FIG. 6 at the location of the nail 50. Other forms of piercing means may also be used as long as it has a pointed end that is instrumental in piercing the ceiling panel for the removal thereof. Also more than two nails may be used spacedly disposed along each of the elongated support members 30 to provide additional holding strength with the ceiling panel.

With the device of the present invention the elongated support arms 30 are meant to be removably mounted with the base member 12 by means of the respective fasteners 40. Thus, the pair of elongated support arms 30 has a use position wherein the elongated support arms 30 are disposed in parallel to each other and substantially transverse to the base member 12, and a nested position wherein the elongated support arms 30 are disposed in parallel with the base member 12. The final nested position is illustrated in FIG. 1. The drawings also show an elastic strap 60 that surrounds the elongated support arms 30 and base member 12 to hold the elongated support arms 30 and base member 12 together, such as in the nested position shown in FIG. 1. The ends of the elastic strap 60 are held to the base member 12, such as by providing knotted ends received in holes in the base member 12, as illustrated in FIG. 3.

The nested position of the device is also illustrated in FIGS. 1-4. Particularly, in FIG. 1 the device is shown in a closed array wherein the elongated support arms 30 have their position reversed from the use position relative to the base member 12. The strap 60 is wound about the device and the support piece 14 keeping the base member 12 and the elongated support arms 30 together. The fasteners 40 are held loosely in place by engagement with the washer 45. The nails 50 fit within the holes 34 so that the elongated support arms both lay flat against the base member 12 to the position of FIG. 1. Refer also to FIG. 3 which shows the alignment between the nails 50 and the accommodating holes 34. FIG. 3 also shows a set of spacers 66 that are secured to the flat said of the base member 12. These spacers, along with the engagement between the nails 50 and holes 34, assist in the positioning of the elongated support arms 30 in parallel to each other and against the flat surface of the base member 12.

FIG. 9 illustrates a workman with the device of the present invention having pierced the ceiling panel that is to be removed. A first step is to engage the panel by the workman thrusting the device upwardly toward the ceiling panel and into engagement with the panel. The nails 50 have sharp pointed ends and thus the thrust by the workman will cause the nails to pierce the ceiling panel and hold the panel securely against a top surface of each of the elongated support arms 30. The next step is to slightly lift the ceiling panel and, if necessary, tilt and/or rotate the panel so that the ceiling panel can be removed through the opening 13. These steps are then repeated for the removal of each individual ceiling panel. Depending on the ceiling height different length poles may be used. In all cases the workman can accomplish the removal without requiring ladders or scaffolding.

Figure 10:
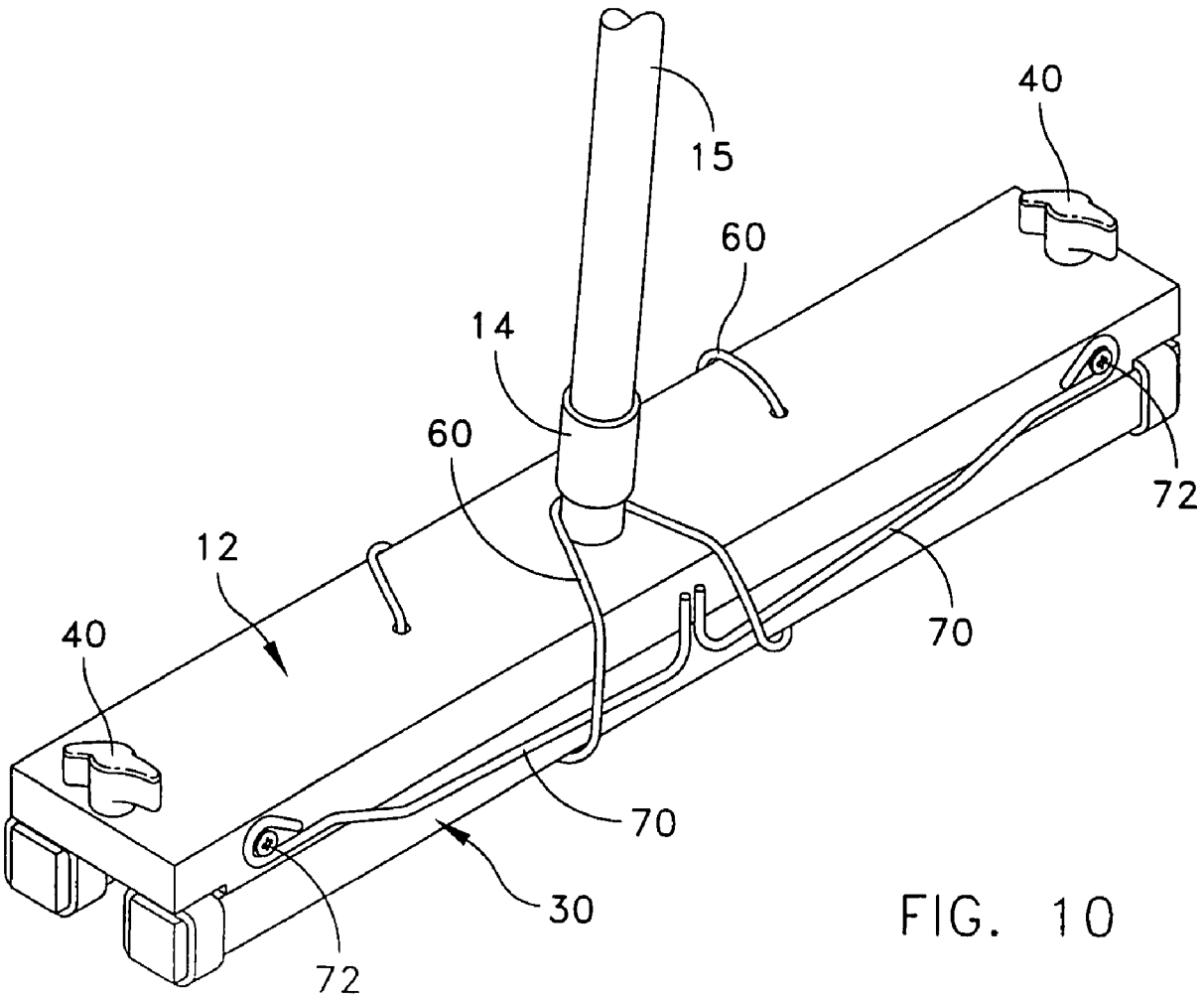
FIG. 10 is a perspective view of a second preferred embodiment of the device of present invention in a nested position and for use in both removing and installing ceiling panels.
Figure 11:
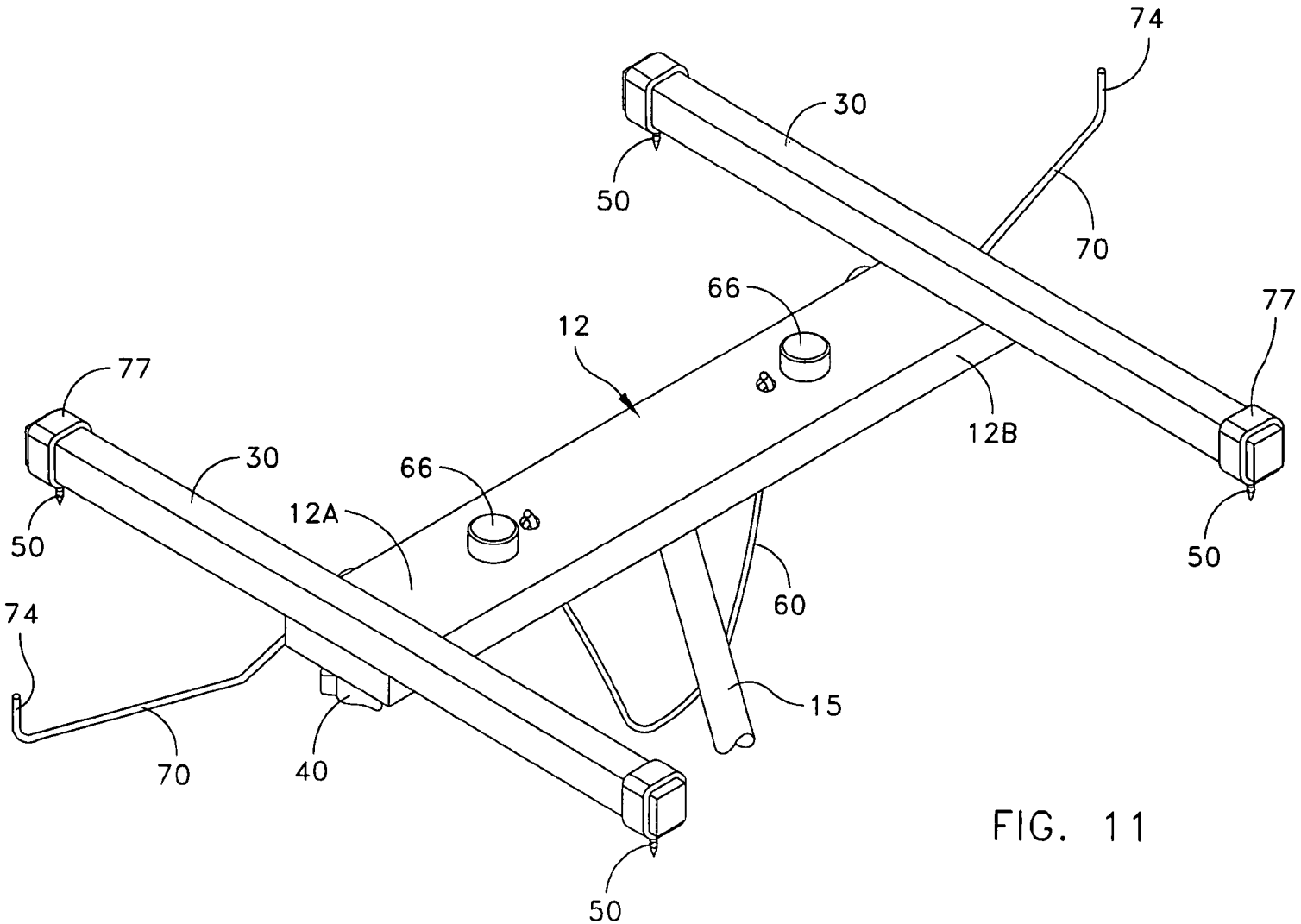
FIG. 11 is a perspective view of the device of FIG. 10 set up in a position for panel installation.
Figure 12:
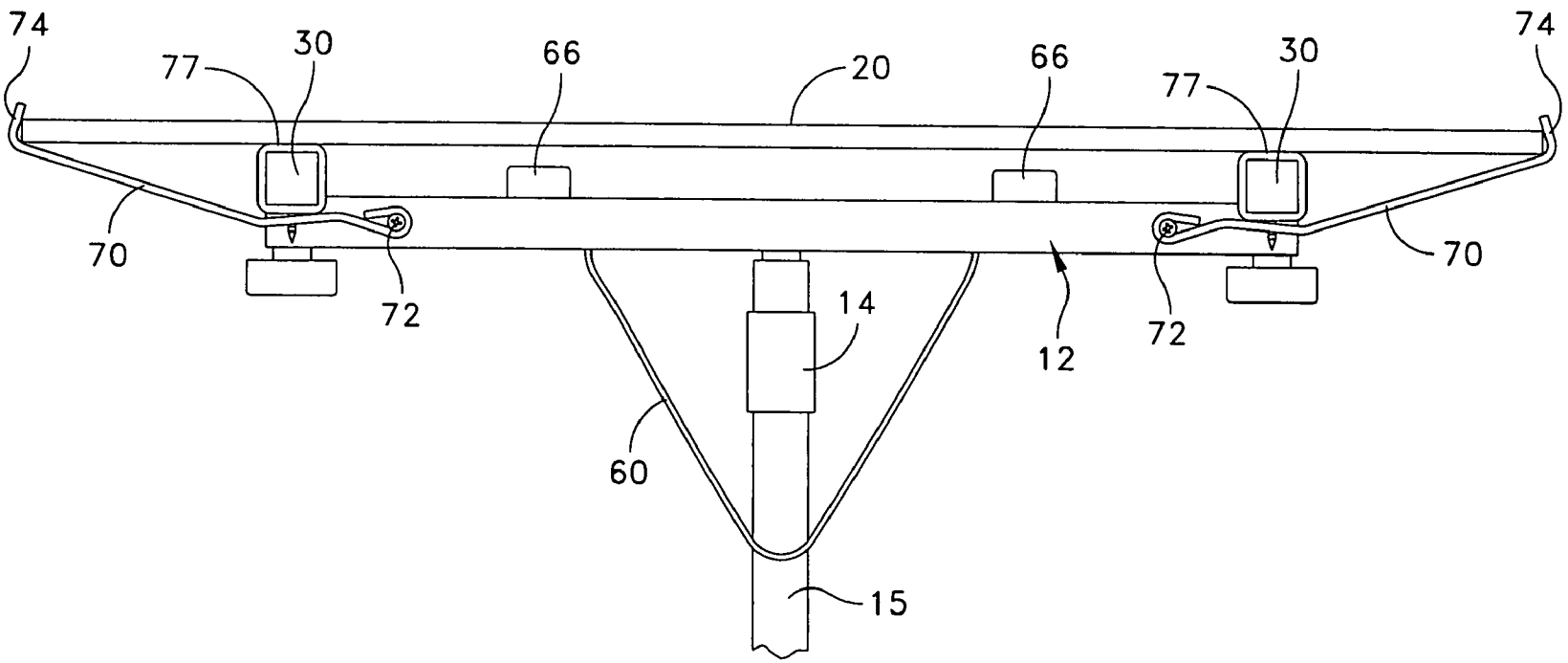
FIG. 12 is a side elevation view of the device of FIG. 10 with the hooks engaging a ceiling panel.
Figure 13:
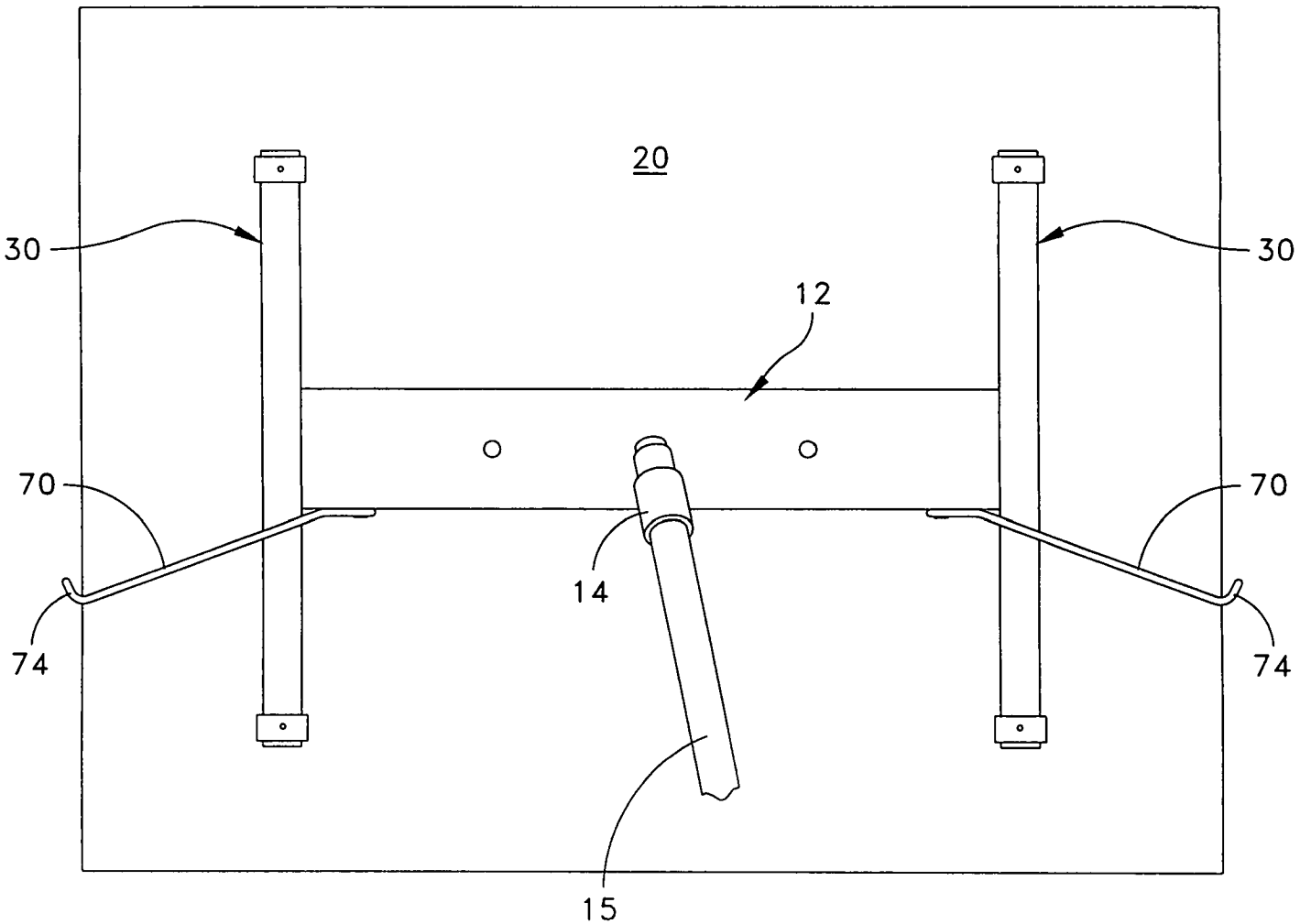
FIG. 13 is a plan view of the device of FIG. 10 with the hooks engaging a ceiling panel.
Figure 14:
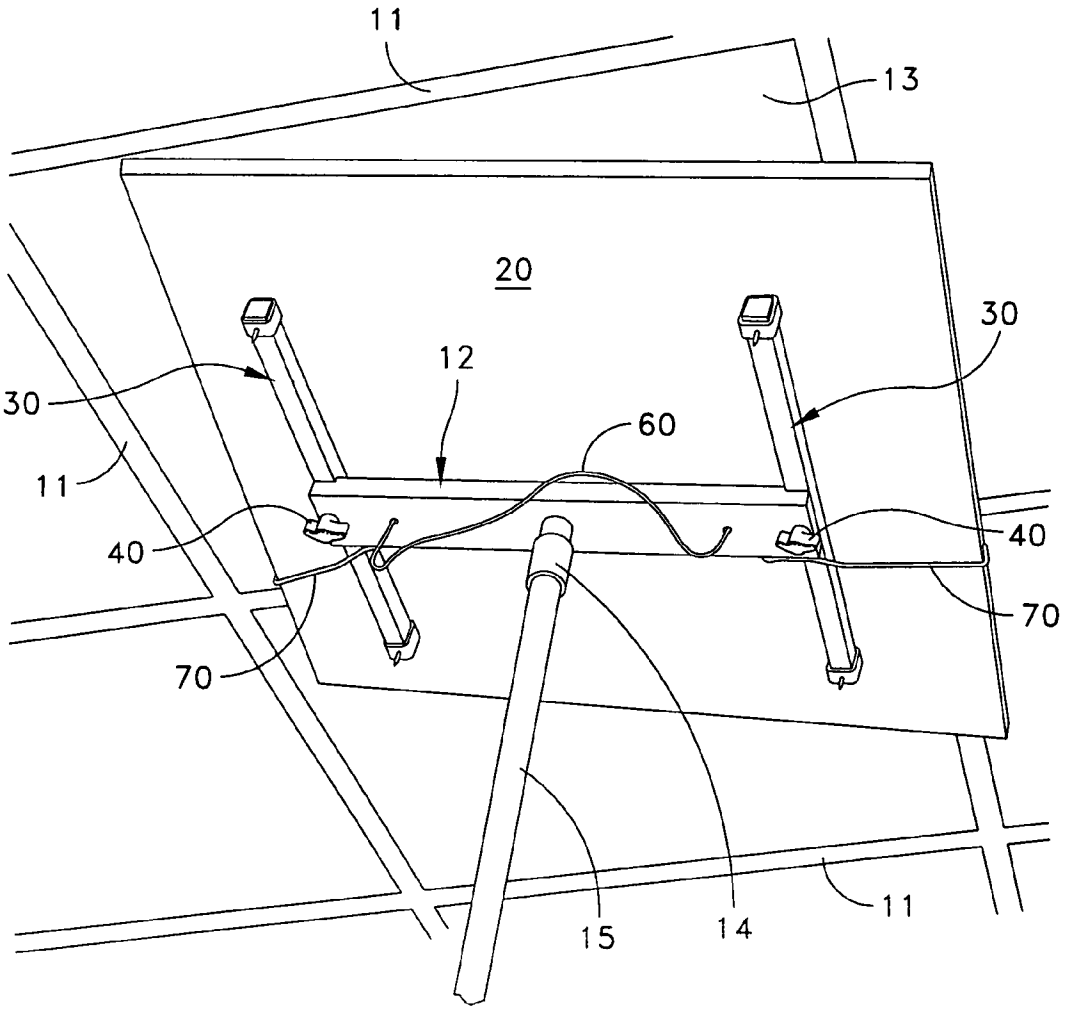
FIG. 14 is a perspective view illustrating the ceiling panel being moved into position for installation thereof.
Figure 15:
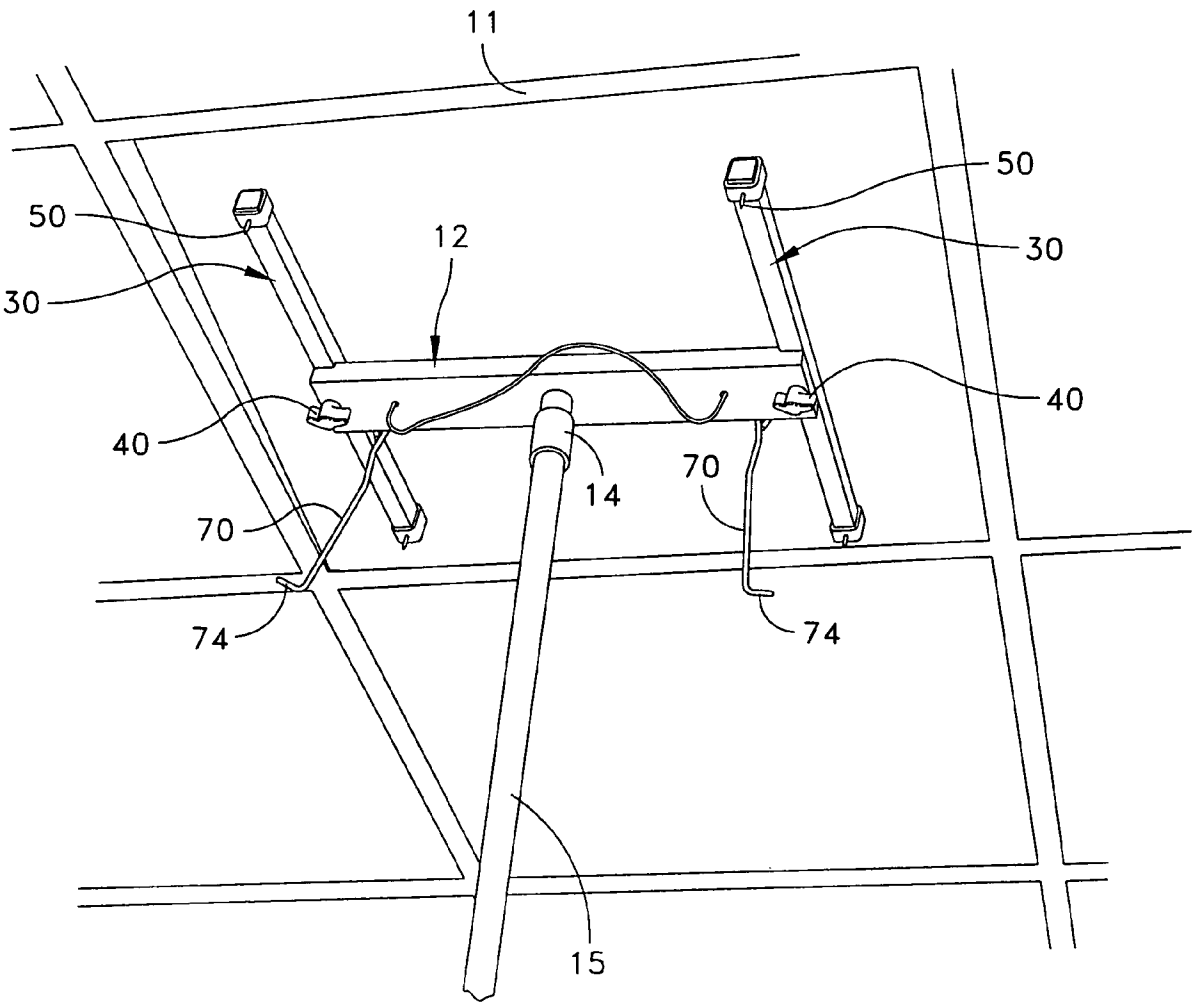
FIG. 15 is a perspective view illustrating a next step in the installation wherein the retention hooks have been disengaged from the ceiling panel.
Figure 16:
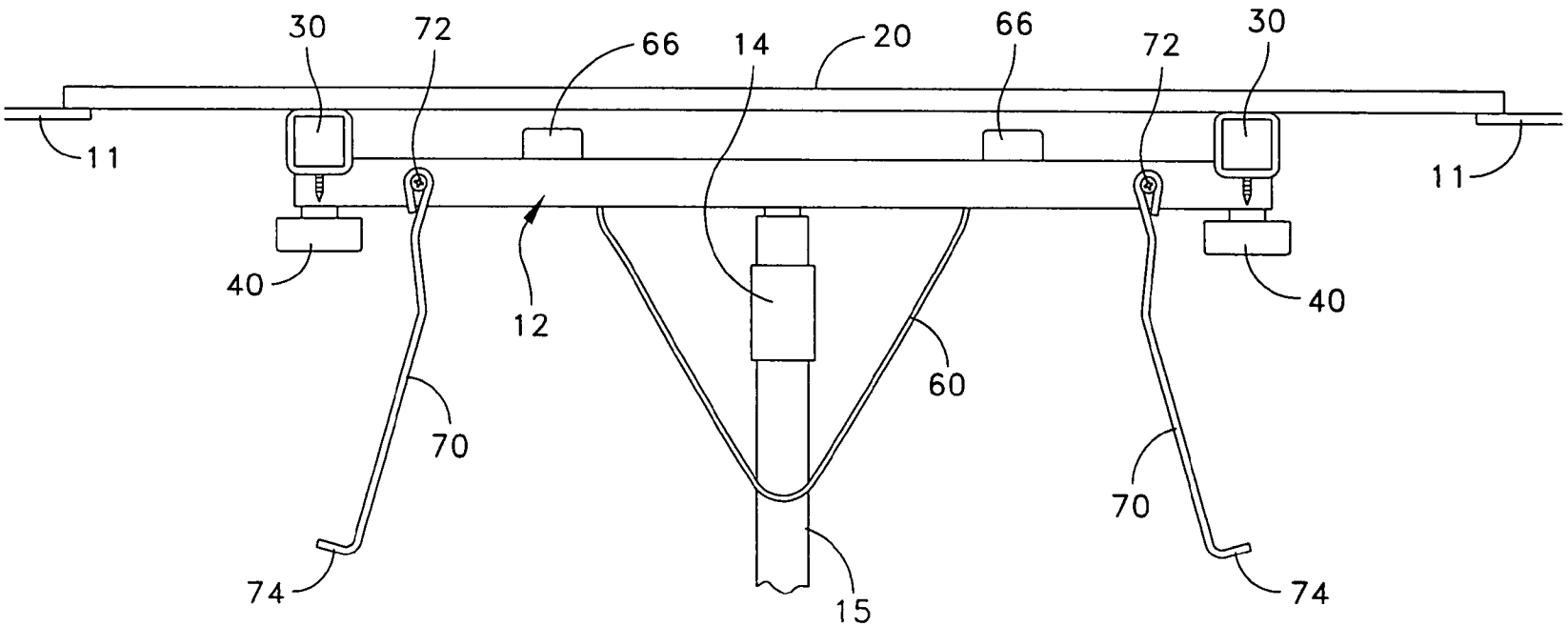
FIG. 16 is a side elevation view of the device of FIG. 10 with the hooks disengaged from the ceiling panel.

As indicated before, a preferred embodiment of the present invention is shown in FIGS. 10-16 where the device includes means for both ceiling panel removal and installation. In FIGS. 10-18 the same reference numbers are used to describe much of the device as previously described before in FIGS. 1-9. This includes the base member 12 and elongated support arms 30. Thus, FIG. 10 is a perspective view of a second preferred embodiment of the device of present invention in a nested position and for use in both removing and installing ceiling panels. FIG. 11 is a perspective view of the device of FIG. 10 set up in a position for panel installation. FIG. 12 is a side elevation view of the device of FIG. 10 with the hooks engaging a ceiling panel. FIG. 13 is a plan view of the device of FIG. 10 with the hooks engaging a ceiling panel. FIG. 14 is a perspective view illustrating the ceiling panel being moved into position for installation thereof. FIG. 15 is a perspective view illustrating a next step in the installation wherein the retention hooks have been disengaged from the ceiling panel. FIG. 16 is a side elevation view of the device of FIG. 10 with the hooks disengaged from the ceiling panel.

In the second embodiment there is illustrated a device 10 that includes a base member 12 having upper and lower substantially flat sides and opposed ends 12A and 12B. A support piece 14 is provided on the base member 12 on the upper side thereof; such as is illustrated in FIG. 10. This support piece 14 is preferably disposed intermediate the opposed ends 12A and 12B of the base member 12. The support piece 14 is for supporting the base member 12 in an overhead position by means of the pole 15. The pole 15 is preferably screwed into the support piece 14. FIGS. 12-16 illustrate the device used for the purpose of installing ceiling panels therewith. In this connection FIG. 14, for example, also shows the typical suspended ceiling system that includes the usual T-shaped cross pieces 11 arranged in a grid pattern. FIG. 14 also shows the ceiling panel 20 being held by the device 10 and in readiness for insertion in the opening 13 defined between these cross pieces 11. The device uses retention hooks for the purpose of holding a new ceiling panel to the device. In the embodiment of FIGS. 10-16 the pair of retention hooks 70 are mounted from the base member 12 at opposed ends thereof. For this purpose each of the retention hooks are pivotally secured by screws 72 that are respectively attached at opposed ends 12A, 12B of the base member 12. Each of the retention hooks 70 has a turned end 74 that engages with the ceiling panel. Refer, for example, to FIG. 12 which illustrates the turned ends 74 engaged with a ceiling panel 20 to assist in the installation thereof. The retention hooks 70 being pivotal about respective screws 72 between a use position (FIG. 12) wherein respective retention hooks are engageable with sides of the ceiling panel, and a released position (FIG. 16) wherein the retention hooks are disengaged from the ceiling panel.

In this second embodiment the device 10 also includes a pair of elongated support arms 30 each also having upper and lower sides and opposed ends 30A and 30B. As shown in the drawings each of the arms 30 has a square or rectangular cross-section. Preferably, at least opposed side surfaces of the elongated support arms are flat so that the arms 30 properly engage with the base member 12, particularly in the use position of the device, such as shown in FIGS. 6 and 9 when removing ceiling panels, or in FIGS. 12-14 when installing ceiling panels. Each elongated support arm 30 is mounted at a location intermediate the opposed ends 30A, 30B of each elongated support arm 30 and to respective opposed ends 12A, 12B of the base member 12. In the use position the elongated support arms 30 are disposed substantially in parallel to each other and substantially transverse to the base member 12.

In this second embodiment described herein the elongated support arms 30 can assume the same position as illustrated before in FIGS. 1-9 for the purpose of removing ceiling panels with each of the elongated support arms engaging the base member 12 and fastened in position so that the nails can engage the panel as the workman thrusts the device into contact with the ceiling panel. Now in FIGS. 10-16 the device is set up so that an opposed side of each of the elongated support arms 30 is engaged with the base member 12. In this position, such as shown in FIG. 11 it is noted that the nails are facing downwardly so as to not be in engagement with the ceiling panel. The ceiling panel 20 thus rests on end bumpers 77 of the elongated support arms 30, and the ceiling panel 20 is thus held in place by the retention hooks 70.

FIG. 10 shows the retention hooks in their nested position held in place by the elastic strap 60. FIGS. 12-14 show the retention hooks 70 engaged with the ceiling panel 20. The retention hooks 70 are pivotal so they can be easily pivoted to a position, such as shown in FIG. 12, where the turned ends thereof engage opposed sides of the ceiling panel. FIG. 12 also shows the ceiling panel 20 resting on the elongated support arms 30, particularly on the bumpers 77. The plan view of FIG. 13 also shows the engagement of the retention hooks with the ceiling panel. FIG. 14 shows the ceiling panel 20, once retained on the device 10, being positioned by the workman and with the retention hooks still engaged with the ceiling panel. FIG. 15 shows a next step in which the retention hooks are easily disengaged from the ceiling panel 20. This is performed by simply jiggling the pole so that the retention hooks disengage from the ceiling panel 20. It is noted that in both FIGS. 15 and 16 the retention hooks have pivoted downwardly out of engagement with the ceiling panel. FIG. 16 shows the final rest position for the panel with the edges thereof resting on the cross-strips 11.

Reference is now made to a third embodiment of the present invention shown in FIGS. 17 and 18. This embodiment is different than that shown in FIGS. 10-16 in that, rather than the retention hooks being supported from opposed ends of the base member 12, the retention hooks 70 are supported from respective elongated support arms 30. In the disclosed embodiment one hook is secured at a same end of respective elongated support arms 30. In an alternate arrangement the retention hooks could be supported from opposite ends of respective elongated support arms 30. In other arrangements the retention hooks can be attached at other locations along the support arms 30. A screw eye 78 may be used for attaching each of the retention hooks to ends of the elongated support arms 30. As in the previous embodiment the retention hooks can be disengaged by simply jiggling the device to release the hooks 70.

Having now described a limited number of embodiment of the present invention, it should now be apparent to one skilled in the art that numerous other embodiments and modifications thereof are contemplated as falling within the scope of the present invention as defined by the appended claims.

What is claimed is:

1. A device for removing and installing ceiling panels, comprising:

a base member having upper and lower sides and opposed ends;

a support piece on the base member on the lower side thereof and disposed intermediate of the opposed ends of the base member;

said support piece for supporting the base member in an overhead position for the purpose of either removing or installing ceiling panels therewith;

a pair of elongated support arms each also having upper and lower sides and opposed ends;

each of said elongated support arms mounted at a location intermediate of the opposed ends of each elongated support arms to respective opposed ends of the base member;

said elongated support arms disposed substantially in parallel to each other and substantially transverse to the base member;

a pair of fasteners, one for each of said elongated support arms, to secure the lower side of each of said elongated support arms to the upper side of the base member at the respective opposed ends of the base member;

at least two piercing pieces mounted to the respective pair of elongated support arms engageable with a ceiling panel to assist in the removal thereof;

a pair of retention hooks mounted from one of the opposed ends of the base member at opposed ends thereof and each of said respective elongated support arms and engageable with a ceiling panel to assist in the installation thereof;

said retention hooks being pivotal between a use position, wherein each of the retention hooks is are engageable with a side of the ceiling panel, and a released position, wherein the retention hooks are disengaged from the ceiling panel;

wherein the pair of elongated support arms has a use position, wherein the elongated support arms are disposed in parallel to each other and substantially transverse to the base member, and a nested position, wherein the elongated support arms are disposed in parallel with the base member, and further including an elastic strap that surrounds the elongated support arms and base member to hold the elongated support arms and base member together.

2. The device of claim 1, wherein the elongated support arms are removably mounted with the base member by means of the respective fasteners.

3. The device of claim 1, including two sets of piercing pieces, with said one set associated with each of said elongated support arms and disposed at said opposed ends of said elongated support arms thereof.

4. The device of claim 3, wherein the base member has opposed end holes for accommodating piercing pieces of the elongated support arms in the nested position of the elongated support arms.

5. The device of claim 4, including at least one spacer on the base member for spacedly positioning the elongated support arms in the nested position.

6. The device of claim 5, wherein the fastener is a threaded bolt and the base has a threaded through hole so that either side of the elongated support arms can engage the base member.

7. The device of claim 6, including a pole attached to the support piece.

8. A device for removing ceiling panels, comprising:

an elongated base member having opposed sides and opposed ends;

a support piece on the base member on one of the opposed sides thereof and disposed of intermediate the opposed ends of the base member;

said support piece for supporting the base member in an overhead position for the purpose of removing ceiling panels therewith;

a pair of elongated support arms each also having opposed sides and opposed ends;

each of said elongated support arms mounted at a location intermediate of the opposed ends of each of said elongated support arms to the respective opposed ends of the base member;

said elongated support arms disposed substantially in parallel to each other and substantially transverse to the base member;

a pair of fasteners, one for each of said elongated support arms, to secure one of the opposed sides of each of said elongated support arms to a respective one of the opposed sides of the base member at the respective opposed ends of the base member;

two sets of piercing pieces, wherein each of said sets associated with each of said elongated support arms and disposed at opposed ends of said elongated support arms thereof;

wherein the pair of elongated support arms has a use position wherein the elongated support arms are disposed substantially in parallel to each other and substantially transverse to the base member.

9. The device of claim 8 wherein the elongated support arms are removably mounted with the base member by means of the respective fasteners.

10. A device for removing ceiling panels, comprising:

an elongated base member having opposed sides and opposed ends;

a support piece on the base member on one of the opposed sides thereof and disposed intermediate of the opposed ends of the base member;

said support piece for supporting the base member in an overhead position for the purpose of removing ceiling panels therewith;

a pair of elongated support arms each also having opposed sides and opposed ends;

each of said elongated support arms mounted at a location intermediate of the opposed ends of each of said elongated support arms the to respective opposed ends of the base member;

said elongated support arms disposed substantially in parallel to each other and substantially transverse to the base member;

a pair of fasteners, one for each of said elongated support arms, to secure one of the opposed sides of each of said elongated support arms to a respective one of the opposed sides of the base member at the respective opposed ends of the base member;

at least two piercing pieces mounted to the respective pair of elongated support arms engageable with a ceiling panel to assist in the removal thereof;

wherein the pair of elongated support arms has a use position, wherein the elongated support arms are disposed in parallel to each other and substantially transverse to the base member, and a nested position wherein the elongated support arms are disposed in parallel with the base member;

further including an elastic strap that surrounds the elongated support arms and base member to hold the elongated support arms and base member together.

11. A device for removing ceiling panels, comprising:

an elongated base member having opposed sides and opposed ends;

a support piece on the base member on one of the opposed sides thereof and disposed intermediate of the opposed ends of the base member;

said support piece for supporting the base member in an overhead position for the purpose of removing ceiling panels therewith;

a pair of elongated support arms each also having opposed sides and opposed ends;

each of said elongated support arms mounted at a location intermediate of the opposed ends of each of said elongated support arms the to respective opposed ends of the base member;

said elongated support arms disposed substantially in parallel to each other and substantially transverse to the base member;

a pair of fasteners, one for each of said elongated support arms, to secure one of the opposed sides of each of said elongated support arms to a respective one of the opposed sides of the base member at the respective opposed ends of the base member;

at least two piercing pieces mounted to the respective pair of elongated support arms engageable with a ceiling panel to assist in the removal thereof;

wherein the pair of elongated support arms has a use position, wherein the elongated support arms are disposed in parallel to each other and substantially transverse to the base member, and a nested position wherein the elongated support arms are disposed in parallel with the base member;

wherein the base member has opposed end holes for accommodating said piercing pieces of he elongated support arms in the nested position of the elongated support arms.

12. A device for removing ceiling panels, comprising:

an elongated base member having opposed sides and opposed ends:

a support piece on the base member on one of the opposed sides thereof and disposed intermediate of the opposed ends of the base member;

said support piece for supporting the base member in an overhead position for the purpose of removing ceiling panels therewith;

a pair of elongated support arms each also having opposed sides and opposed ends;

each of said elongated support arms mounted at a location intermediate of the opposed ends of each of said elongated support arms to the respective opposed ends of the base member;

said elongated support arms disposed substantially in parallel to each other and substantially transverse to the base member;

a pair of fasteners, one for each of said elongated support arms, to secure one of the opposed sides of each of said elongated support arms to a respective one of the opposed sides of the base member at the respective opposed ends of the base member;

at least two piercing pieces mounted to the respective pair of elongated support arms engageable with a ceiling panel to assist in the removal thereof;

wherein the pair of elongated support arms has a use position, wherein the elongated support arms are disposed in parallel to each other and substantially transverse to the base member, and a nested position wherein the elongated support arms are disposed in parallel with the base member;

at least one spacer on the base member for spacedly positioning the elongated support arms in the nested position.

13. A device for removing ceiling panels, comprising:

an elongated base member having opposed sides and opposed ends;

a support piece on the base member on one of the opposed sides thereof and disposed intermediate of the opposed ends of the base member;

said support piece for supporting the base member in an overhead position for the purpose of removing ceiling panels therewith;

a pair of elongated support arms each also having opposed sides and opposed ends;

each of said elongated support arms mounted at a location intermediate of the opposed ends of each of said elongated support arms to the respective opposed ends of the base member;

said elongated support arms disposed substantially in parallel to each other and substantially transverse to the base member;

a pair of fasteners, one for each of said elongated support arms, to secure one of the opposed sides of each of said elongated support arms to a respective one of the opposed sides of the base member at the respective opposed ends of the base member;

at least two piercing pieces mounted to the respective pair of elongated support arms engageable with a ceiling panel to assist in the removal thereof;

wherein the pair of elongated support arms has a use position, wherein the elongated support arms are disposed substantially in parallel to each other and substantially transverse to the base member;

a pole attached to the support piece.

14. A device for installing ceiling panels, comprising:

an elongated base member having opposed sides and opposed ends;

a support piece on the base member one of the opposed sides thereof and disposed intermediate of the opposed ends of the base member;

said support piece for supporting the base member in an overhead position for the purpose of installing ceiling panels therewith;

a pair of elongated support arms each also have opposed sides and opposed ends;

each of said elongated support arms mounted at a location intermediate of the opposed ends of each of said elongated support arms to the respective opposed ends of the base member;

said of said elongated support arms disposed in parallel to each other and substantially transverse to the base member;

a pair of fasteners, one for each of said elongated support arms, to secure one of the opposed sides of each of said elongated support arms to a respective one of the base member at the respective opposed ends of the base member;

a pair of retention hooks mounted from one of the opposed ends of the base member thereof and each of said respective elongated support arms and engageable with a ceiling panel to assist in the installation thereof;

said retention hooks being pivotal between a use position, wherein each of the retention hooks is engageable with a side of the ceiling panel, and a released position, wherein the retention hooks are disengaged from the ceiling panel;

wherein the elongated support arms are removable mounted with the base member by means of the respective fasteners; and wherein the pair of elongated support arms has a use position, wherein the elongated support arms are disposed in parallel to each other and substantially transverse to the base member, and a nested position, wherein the elongated support arms are disposed in parallel with the base member, and further including an elastic strap that surrounds the elongated support arms and base member to hold the elongated support arms and base member together.

* * * * *